US011148907B2

(12) United States Patent
Schmidt et al.

(10) Patent No.: US 11,148,907 B2
(45) Date of Patent: Oct. 19, 2021

(54) ELEVATOR ENTRYWAY WITH MAGNETIC GUIDANCE FOR CONTROLLING DOOR PANEL MOTION

(71) Applicant: Otis Elevator Company, Farmington, CT (US)

(72) Inventors: Walter Thomas Schmidt, Marlborough, CT (US); James Chmiel, Suffield, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 381 days.

(21) Appl. No.: 16/275,837

(22) Filed: Feb. 14, 2019

(65) Prior Publication Data

US 2020/0262682 A1 Aug. 20, 2020

(51) Int. Cl.
*B66B 13/08* (2006.01)
*B66B 13/30* (2006.01)

(52) U.S. Cl.
CPC ..... *B66B 13/08* (2013.01); *B66B 13/301* (2013.01)

(58) Field of Classification Search
CPC .. B66B 13/08; B66B 13/301; E05Y 2201/462
See application file for complete search history.

(56) References Cited

U.S. PATENT DOCUMENTS 8,020,346 B2 9/2011 Singiser et al.
8,132,653 B2 * 3/2012 Flynn ..... B66B 13/08 187/316
9,593,519 B2 * 3/2017 Branco Teixeira ..... E05D 15/06
9,719,282 B2 8/2017 Bellei
2018/0148965 A1 5/2018 Lam

FOREIGN PATENT DOCUMENTS

| | | | |
|---|---|---|---|
| CN | 204492514 | U | 7/2015 |
| CN | 107265270 | A | 10/2017 |
| EP | 0741224 | A1 | 11/1996 |
| EP | 2594521 | A1 | 5/2013 |
| JP | H09272680 | A | 10/1997 |
| JP | 2000087636 | A | 3/2000 |
| JP | 2000248820 | A | 9/2000 |
| JP | 2001027069 | A | 1/2001 |
| JP | 2012076863 | A | 4/2012 |
| KR | 20080077871 | A | 8/2008 |
| WO | 2007073376 | A1 | 6/2007 |
| WO | 2011090369 | A1 | 7/2011 |

OTHER PUBLICATIONS

"MagneGlide" Modern Transport Systems Corp.; 2014; youtube; Retrived from the Internet, URL: http://www.magsupport.com/magneglide; 7pages.
European Search Report; Application No. 19217480.3-1001; dated Jul. 15, 2020; 7 pages.

* cited by examiner

*Primary Examiner* — Diem M Tran
(74) *Attorney, Agent, or Firm* — Cantor Colburn LLP

(57) ABSTRACT

Disclosed is an elevator system having: a door panel configured for moving along a first axis for opening and closing of the door panel at an entryway, the door panel having a door magnet, the entryway including a sill, the sill having a sill magnet, wherein the door magnet and the sill magnet are configured for forming a first magnetic pairing, and wherein the first magnetic pairing guides the door panel to move along the first axis and prevents the door panel from moving in a lateral direction with respect to the first axis.

16 Claims, 2 Drawing Sheets

ELEVATOR ENTRYWAY WITH MAGNETIC GUIDANCE FOR CONTROLLING DOOR PANEL MOTION

BACKGROUND

The embodiments herein relate to elevator systems and more specifically to an elevator entryway using magnetic guidance to control door panel motion.

Sill located debris may be considered a leading cause of unscheduled elevator maintenance. Existing elevator designs may guide an elevator door by utilizing a combination of rollers and rails at a top level of the elevator door and a combination of a groove and groove guides (for example, protrusions) that are guided within the groove at a base of the door. The groove may be located in an elevator sill and may collect debris, which may be challenging to remove.

BRIEF SUMMARY

Disclosed is an elevator system comprising: a door panel configured for moving along a first axis for opening and closing of the door panel at an entryway, the door panel comprising a door magnet, the entryway including a sill, the sill having a sill magnet, wherein the door magnet and the sill magnet are configured for forming a first magnetic pairing, and wherein the first magnetic pairing guides the door panel to move along the first axis and prevents the door panel from moving in a lateral direction with respect to the first axis.

In addition to one or more of the above disclosed features or as an alternate, a top surface of the sill is without inset guide grooves.

In addition to one or more of the above disclosed features or as an alternate, the door panel comprises a base and the door magnet is at or proximate the base.

In addition to one or more of the above disclosed features or as an alternate, the sill includes a sill enclosure that is sealed, and the sill magnet is within the sill enclosure.

In addition to one or more of the above disclosed features or as an alternate, the sill enclosure includes a track that extends along the first axis and the sill magnet is movable along the track for traveling in the first axis with the door magnet when the door is opening and closing.

In addition to one or more of the above disclosed features or as an alternate, the sill magnet is movably supported on the track by at least one roller.

In addition to one or more of the above disclosed features or as an alternate, the door magnet is a first set of magnets that comprises a first magnet and a second magnet spaced along the first axis by a first distance, the sill magnet is a second set of magnets that comprises a third magnet and a fourth magnet that are spaced along the first axis by the first distance, whereby as the door panel moves along the first axis, the first magnet is aligned with the third magnet and the second magnet is aligned with the fourth magnet.

In addition to one or more of the above disclosed features or as an alternate, the third magnet and the fourth magnet are spaced by a mechanical spacer that extend along the first axis.

In addition to one or more of the above disclosed features or as an alternate, the track includes a pair of track rails, including a first track rail and a second track rail, the pair of track rails extending along the first axis and being spaced from each other in the lateral direction; and the third magnet and the fourth magnet each comprise: a first roller of the at least one roller, the first roller traveling on the first track rail; and a second roller of the at least one roller, the second roller traveling on the second track rail.

In addition to one or more of the above disclosed features or as an alternate, the first roller and the second roller are each a pair of rollers.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
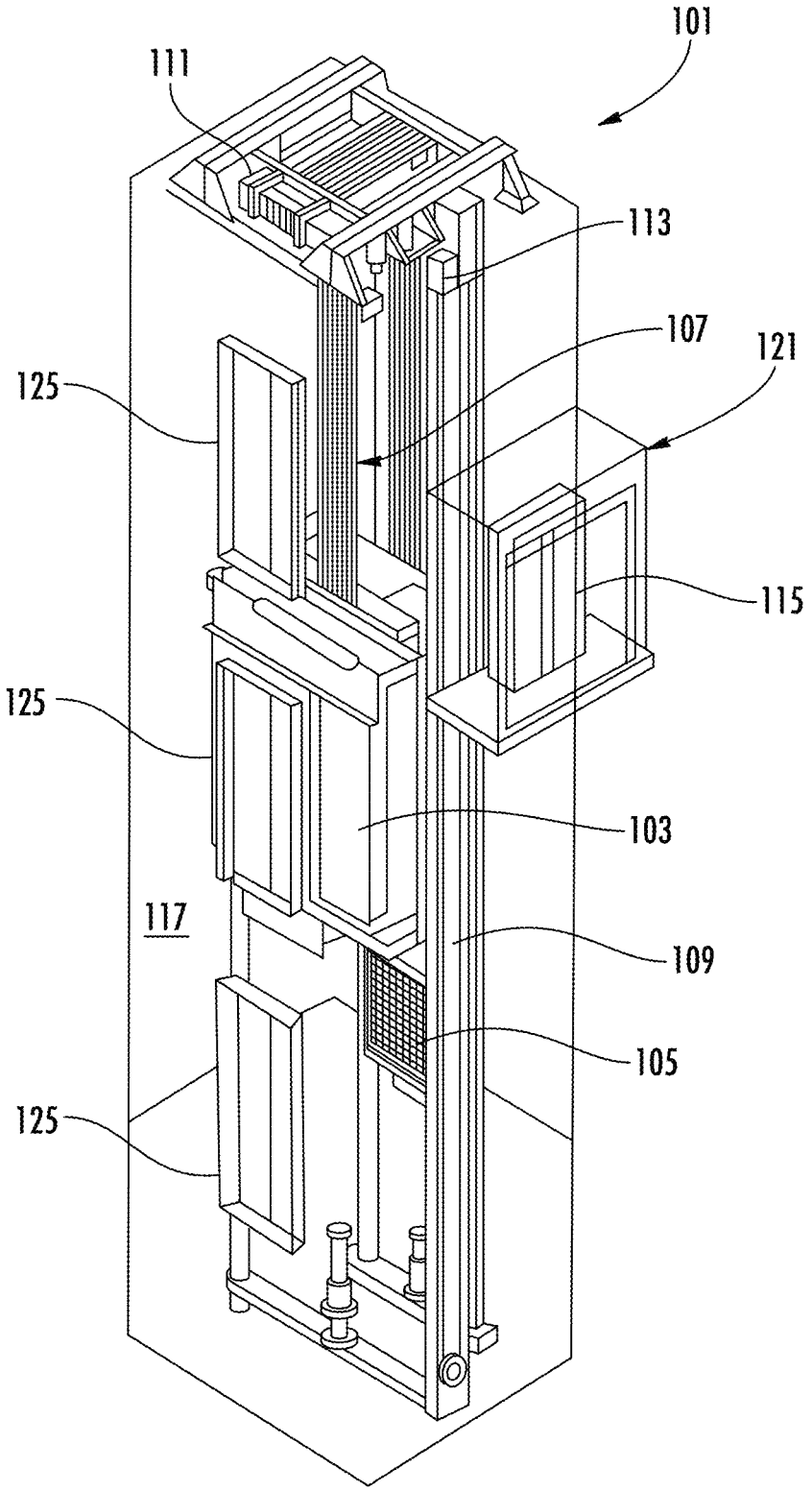
FIG. 1 is a schematic illustration of an elevator system that may employ various embodiments of the present disclosure.

FIG. 1 is a perspective view of an elevator system 101 including an elevator car 103, a counterweight 105, a tension member 107, a guide rail 109, a machine 111, a position reference system 113, and a controller 115. The elevator car 103 and counterweight 105 are connected to each other by the tension member 107. The tension member 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The tension member 107 engages the machine 111, which is part of an overhead structure of the elevator system 101. The machine 111 is configured to control movement between the elevator car 103 and the counterweight 105. The position reference system 113 may be mounted on a fixed part at the top of the elevator shaft 117, such as on a support or guide rail, and may be configured to provide position signals related to a position of the elevator car 103 within the elevator shaft 117. In other embodiments, the position reference system 113 may be directly mounted to a moving component of the machine 111, or may be located in other positions and/or configurations as known in the art. The position reference system 113 can be any device or mechanism for monitoring a position of an elevator car and/or counter weight, as known in the art. For example, without limitation, the position reference system 113 can be an encoder, sensor, or other system and can include velocity sensing, absolute position sensing, etc., as will be appreciated by those of skill in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position reference system 113 or any other desired position reference device. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101. In one embodiment, the controller may be located remotely or in the cloud.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor. The machine 111 may include a traction sheave that imparts force to tension member 107 to move the elevator car 103 within elevator shaft 117.

Although shown and described with a roping system including tension member 107, elevator systems that employ other methods and mechanisms of moving an elevator car within an elevator shaft may employ embodiments of the present disclosure. For example, embodiments may be employed in ropeless elevator systems using a linear motor to impart motion to an elevator car. Embodiments may also be employed in ropeless elevator systems using a hydraulic lift to impart motion to an elevator car. FIG. 1 is merely a non-limiting example presented for illustrative and explanatory purposes.

The following figures illustrate additional technical features associated with one or more disclosed embodiments. Features disclosed in the following figures having nomenclature similar to features disclosed in FIG. 1 may be similarly construed though being positively reintroduced with numerical identifiers that may differ from those in FIG. 1.

Figure 3:
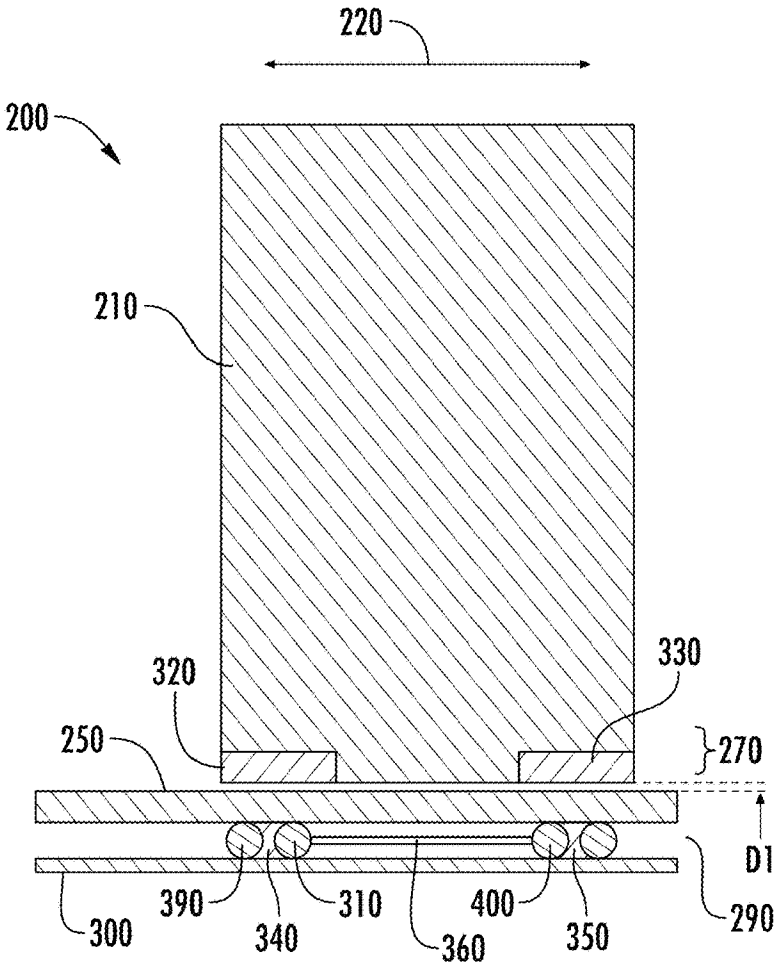
FIG. 3 illustrates a front view of implements of an elevator system that may employ various embodiments of the present disclosure.
Figure 2:
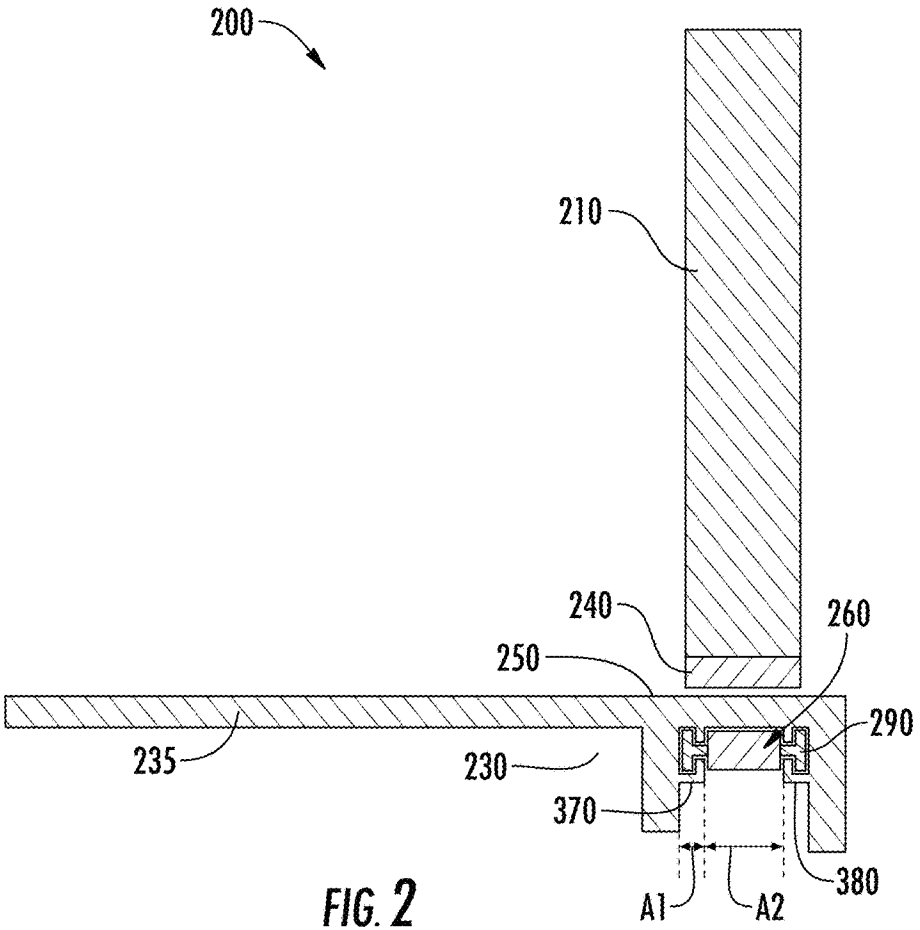
FIG. 2 illustrates a side view of implements of an elevator system that may employ various embodiments of the present disclosure.

Turning to FIGS. 2 and 3, disclosed is an elevator system 200. The system 200 includes a door panel 210 configured for moving along a first axis 220 for opening and closing of the door panel 210 at an entryway 230. The door panel 210 includes a door magnet 240. The door panel 210 as identified herein may be a bottom half of an elevator door, where a top half (not illustrated) is guided by typical means such as rollers/rails.

The entryway 230 including a sill 250. The sill 250 has a sill magnet 260. The door magnet 240 and the sill magnet 260 may be configured for forming a first magnetic pairing. According to an embodiment the first magnetic pairing guides the door panel 210 to move along the first axis 220 and prevents the door panel 210 from moving in a lateral direction with respect to the first axis 220. For example, the first magnetic pairing prevents the door from swinging inwardly and outwardly with respect to the entryway 230, laterally with respect to the first axis 220, to thereby avoid interaction with passengers. Sizing and configuring of the magnets may provide for such restrictive motion.

With the use of magnets for guiding the door panel, a top surface of the sill that faces a bottom of the door panel may without guide-tracks. For example, the surface may without inset guide grooves so that it be a flat-planar surface or may contain surface indicia to enable walking traction. That is, the surface may exclude grooves associated with other door panel guide configurations.

According to an embodiment, the first magnetic pairing may be passive. This prevents providing an additional electrical burden on the elevator system. In one embodiment, platform structures 235 of the entryway 230 are non-ferrous metals to avoid biasing the magnets.

In one embodiment the door panel 210 may include a base 270. The base 270 may be defined by a bottom portion of the door panel 210. The door magnet 240 may be disposed at or proximate the base 270.

In one embodiment the sill 250 may include a sill enclosure 290 that is sealed. The sill magnet 260 may be disposed within the sill enclosure 290. The sill enclosure 290 may include a track 300 that extends along the first axis 220. The sill magnet 260 may be movable along the track 300 for traveling along the first axis 220 with the first magnet 240. The sill magnet 260 may be movably supported on the track 300 by at least one roller 310.

The door magnet 240 may be a first set of magnets that comprises a first magnet 320 and a second magnet 330 spaced along the first axis 220 by a first distance. The sill magnet 260 may be a second set of magnets that comprises a third magnet 340 and a fourth magnet 350 that are spaced along the first axis 220 by the first distance. From this configuration, as the door panel 210 moves along the first axis 220, the first magnet 320 may be aligned with the third magnet 340 and the second magnet 330 may be aligned with the fourth magnet 350.

The third magnet 340 and the fourth magnet 350 may be spaced by a mechanical spacer 360. The mechanical spacer 360 may extend along the first axis 220. The mechanical spacer 360 may be a frame structure such as a bar, a cylinder or other formed or machined member.

The track 300 may include a pair of track rails, including a first track rail 370 and a second track rail 380. The pair of track rails 370, 380 may extend along the first axis and may be spaced from each other in the lateral direction. In one embodiment the third magnet 340 and the fourth magnet 350 each comprise a first roller 390 of the at least one roller 310 that that travels on the first track rail 370 and a second roller 400 of the at least one roller 310 that travels on the second track rail 380. As illustrated the first roller 390 and the second roller 400 are each a pair of rollers.

In order to optimize a utilization of the available magnetic strength, a spacing D1 between a bottom of the panel 210 and the sill 250 may be a few millimeters, such as three millimeters. For the same reason, a thickness of the sill 250 may be the same as D1. The sill 250 may be designed to accommodate such thickness without buckling under the weight of normal use. For example, the sill 250 may be a reinforced and/or composite material. In addition, the thickness of the sill 250 may change between areas A1 where the magnets are directly below the sill 250 and, for example, areas A2 where the rollers are directly below the sill 250. That is, areas where the rollers are directly below the sill 250 may be thicker than areas magnets are directly below the sill 250.

The above disclosed embodiments provide a plurality of sets of paired magnets including a first set of magnets within a door panel and a second set of magnets underneath the sill. The door may be guided along a travel path without the need of a groove. Such configuration may eliminating a formation of debris that may otherwise impeding door movement. Magnet sets may be configured, for example, with magnetic strength characteristics that may prevent door movement out of a door sliding axis. In one embodiment the magnets are rare earth magnets such as neodymium. Magnetic attraction may be passive rather than requiring power to avoid affecting power requirements for the elevator system.

Alternatively electromagnets may be utilized. If electromagnets are used, such magnets may be used in either the door or sill of the assembly. Placing electromagnets in the sill may avoid providing power to the door panels. In addition, electrical cables for a sill electromagnet may be hidden behind a toe guard positioned behind the sill.

Within the sill, magnets may be placed on rollers to enable traveling of the magnets in the door sliding axis. The rollers may be placed in enclosed track, thereby being insulated from debris. The sill magnets may be provided as a plurality of sets spaced along the door sliding axis and the door magnet may be provided as a plurality of sets spaced along the door sliding axis. Spacing between the plurality of sets of sill magnets may obtained, for example, by a mechanical connection between the plurality of sets of sill magnets. Such spacing between the sets of sill magnets and sets of door magnets may the same to provide for control of the door panel.

Various benefits of the disclosed embodiments include reduced of unscheduled elevator maintenance due to removal of a groove based opportunity to collect debris. In addition, noise associated with mechanical interaction between protrusions and grooves and groove guides.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, subcombinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. An elevator system comprising:

a door panel configured for moving along a first axis for opening and closing of the door panel at an entryway, the door panel comprising a door magnet, the entryway including a sill, the sill having a sill magnet, wherein the door magnet and the sill magnet are configured for forming a first magnetic pairing, and wherein the first magnetic pairing guides the door panel to move along the first axis and prevents the door panel from moving in a lateral direction with respect to the first axis, wherein:

the sill includes a sill enclosure that is sealed, and the sill magnet is within the sill enclosure; and the sill enclosure includes a track that extends along the first axis and the sill magnet is movable along the track for traveling in the first axis with the door magnet when the door is opening and closing.

2. The system of claim 1, wherein a top surface of the sill is without inset guide grooves.

3. The system of claim 1, wherein the door panel comprises a base and the door magnet is at or proximate the base.

4. The system of claim 1, wherein the sill magnet is movably supported on the track by at least one roller.

5. The system of claim 1, wherein:

the door magnet is a first set of magnets that comprises a first magnet and a second magnet spaced along the first axis by a first distance, the sill magnet is a second set of magnets that comprises a third magnet and a fourth magnet that are spaced along the first axis by the first distance, whereby as the door panel moves along the first axis, the first magnet is aligned with the third magnet and the second magnet is aligned with the fourth magnet.

6. The system of claim 5, wherein the third magnet and the fourth magnet are spaced by a mechanical spacer that extend along the first axis.

7. The system of claim 5, wherein:

the track includes a pair of track rails, including a first track rail and a second track rail, the pair of track rails extending along the first axis and being spaced from each other in the lateral direction; and the third magnet and the fourth magnet each comprise:

a first roller of the at least one roller, the first roller traveling on the first track rail; and a second roller of the at least one roller, the second roller traveling on the second track rail.

8. The system of claim 7, wherein the first roller and the second roller are each a pair of rollers.

9. A method of configuring an elevator system comprising:

configuring a door panel for moving along a first axis for opening and closing of the door panel at an entryway, the door panel comprising a door magnet, wherein the entryway includes a sill, the sill includes a sill magnet, and configuring the door magnet and the sill magnet for forming a first magnetic pairing, wherein the first magnetic pairing guides the door panel to move along the first axis and prevents the door panel from moving in a lateral direction with respect to the first axis, wherein:

the sill includes a sill enclosure that is sealed, and the sill magnet is within the sill enclosure; and the sill enclosure includes a track that extends along the first axis and the sill magnet is movable along the track for traveling in the first axis with the door magnet when the door is opening and closing.

10. The method of claim 9, wherein a top surface of the sill is without inset guide grooves.

11. The method of claim 9, wherein the door panel comprises a base and the door magnet is at or proximate the base.

12. The method of claim 9, wherein the sill magnet is movably supported on the track by at least one roller.

13. The method of claim 9, wherein:

the door magnet is a first set of magnets that comprises a first magnet and a second magnet spaced along the first axis by a first distance, the sill magnet is a second set of magnets that comprises a third magnet and a fourth magnet that are spaced along the first axis by the first distance, whereby as the door panel moves along the first axis, the first magnet is aligned with the third magnet and the second magnet is aligned with the fourth magnet.

14. The method of claim 13, wherein the third magnet and the fourth magnet are spaced by a mechanical spacer that extend along the first axis.

15. The method of claim 13, wherein:

the track includes a pair of track rails, including a first track rail and a second track rail, the pair of track rails extending along the first axis and being spaced from each other in the lateral direction; and the third magnet and the fourth magnet each comprise:

a first roller of the at least one roller, the first roller traveling on the first track rail; and a second roller of the at least one roller, the second roller traveling on the second track rail.

16. The method of claim 15, wherein the first roller and the second roller are each a pair of rollers.

* * * * *